US010978790B2

(12) United States Patent
Kramer

(10) Patent No.: US 10,978,790 B2
(45) Date of Patent: Apr. 13, 2021

(54) ELECTROMAGNETIC RADIATION ATTENUATING DEVICE FOR LAPTOP COMPUTERS

(71) Applicant: Mark P Kramer, Spring Lake, MI (US)

(72) Inventor: Mark P Kramer, Spring Lake, MI (US)

( * ) Notice: Subject to any disclaimer, the term of this patent is extended or adjusted under 35 U.S.C. 154(b) by 267 days.

(21) Appl. No.: 16/122,626

(22) Filed: Sep. 5, 2018

(65) Prior Publication Data

US 2019/0081390 A1 Mar. 14, 2019

Related U.S. Application Data

(60) Provisional application No. 62/557,323, filed on Sep. 12, 2017.

(51) Int. Cl.

| | |
|---|---|
| ***H01Q 1/00*** | (2006.01) |
| ***H01Q 1/38*** | (2006.01) |
| ***H01Q 1/24*** | (2006.01) |
| ***H01Q 1/52*** | (2006.01) |
| ***H01Q 17/00*** | (2006.01) |
| *H01Q 1/22* | (2006.01) |

(52) U.S. Cl.

CPC ..... *H01Q 1/245* (2013.01); *H01Q 1/38* (2013.01); *H01Q 1/526* (2013.01); *H01Q 17/00* (2013.01); *H01Q 1/2266* (2013.01)

(58) Field of Classification Search

CPC ..... H01Q 1/245; H01Q 17/00; H01Q 1/38; H01Q 1/526; H01Q 1/2266

See application file for complete search history.

(56) References Cited

U.S. PATENT DOCUMENTS

| | | | | |
|---|---|---|---|---|
| 5,294,826 | A * | 3/1994 | Marcantonio | H01L 23/315 257/659 |
| 5,336,848 | A * | 8/1994 | Katz | G06F 1/1628 174/384 |
| 7,135,643 | B2 * | 11/2006 | van Haaster | G02B 6/4277 174/382 |
| D750,057 | S | 2/2016 | Rhoades | |
| 9,251,458 | B2 * | 2/2016 | Finn | H01Q 1/2225 |
| 9,263,796 | B1 * | 2/2016 | Sanchez | H01Q 1/245 |

(Continued)

OTHER PUBLICATIONS

EFLEKTOR Cell Phone Radiation Shield, Amazon.com; Date First Available Jun. 11, 2014 ;4 pages.*

(Continued)

*Primary Examiner* — Trinh V Dinh

(74) *Attorney, Agent, or Firm* — Hultman Law, PLC; Eric Andrew Hultman, Esq.

(57) ABSTRACT

An apparatus for the attenuating of electromagnetic radiation is provided herein and comprises a layered support substrate, wherein said support substrate comprises at least one of the following electromagnetic radiation attenuating layers: an electrically conductive fabric; a microwave absorbing layer; or a magnetic shielding layer. The support substrate further comprises a surrounding material which envelops the entirety of the electromagnetic radiation attenuating layers. The support substrate is formed to include a forward electromagnetic radiation attenuating surface and is intended for use with laptop computers.

18 Claims, 18 Drawing Sheets

(56) References Cited

U.S. PATENT DOCUMENTS

2002/0029893 A1* 3/2002 Toyoda ..... H05K 9/0088 174/377
2006/0011054 A1* 1/2006 Walthall ..... F42D 5/045 86/50
2006/0022054 A1* 2/2006 Elhamias ..... G06F 3/0607 235/492
2014/0106812 A1* 4/2014 Schmidt ..... H01Q 1/52 455/550.1
2014/0111684 A1* 4/2014 Corbin ..... H04N 5/2257 348/374
2014/0203020 A1* 7/2014 Trombino ..... A45C 13/18 220/500
2014/0209691 A1* 7/2014 Finn ..... H05K 1/0233 235/492
2018/0340903 A1* 11/2018 Heikenfeld ..... A61B 5/05
2019/0081390 A1* 3/2019 Kramer ..... H01Q 1/245
2020/0227358 A1* 7/2020 Kikitsu ..... H05K 9/0088

OTHER PUBLICATIONS

Unknown, https://harapad.cornishop/laptopilaptop-emf-protection/ , Hara Pad, Hara Pad, 2 Pages, online.
Unknown, https://www.defendershield.cornidefenderpad-laptop-radiation-heat-shield , Defender Pad, Defender Pad, 3 pages, online.
Unknown, http://www.lessemf.com/1212.pdf , Pure Copper Polyester Taffeta Fabric, 1 pages, online.
Unknown, http://www.lessemf.com/276.html , Magnetic Shielding Foil, 1 page, online.
Unknown, http://www.lessemf.com/fabric5.html#259 , Microwave Absorbing Sheet, 1 page, online.
Unknown, http://www.eflektor.com/ - website capture provided via attached .pdf, dated Oct. 23, 2020.

* cited by examiner

ELECTROMAGNETIC RADIATION ATTENUATING DEVICE FOR LAPTOP COMPUTERS

CROSS REFERENCE TO RELATED APPLICATION

This application is a non-provisional application claiming priority to an earlier filed U.S. provisional patent application entitled, "Electromagnetic radiation attenuating device for laptop computers," filed Sep. 12, 2017, and assigned Ser. No. 62/557,323, the contents of which are incorporated herein by reference.

BACKGROUND OF THE INVENTION

Field of the Invention

The present invention generally relates to attenuation devices for electromagnetic radiation, more specifically for electromagnetic radiation attenuating devices for laptop computers and particularly to electromagnetic radiation attenuating devices for laptop computers containing a forward electromagnetic radiation attenuating surface.

Description of the Related Art

It is known that all electronic devices emit radiation in the form of electromagnetic waves. Different devices will emit electromagnetic radiation of different frequencies. For example, microwaves, cell phones, and laptops all emit different types of radiation due to their varying frequencies. All electromagnetic radiation is of the non-ionizing form. This is in contrast to ionizing radiation emitted by x-rays and gamma-rays. Non-ionizing radiation does not carry enough energy per quantum to remove electrons from atoms. Rather, it excites the electrons and moves them to higher energy levels. It is this excitation of electrons that renders electromagnetic radiation harmful to humans. The radiation causes increased cell proliferation, which results in cellular division before the DNA is fully developed and ultimately causes cell mutation.

Generally, these electromagnetic fields reach dangerous levels near to their source, but tend to fade out quickly over short distances. Only inches away from of the source, the radiation is attenuated to non-harmful levels. It becomes apparent that electronic devices which are held or placed close to one's body may pose health hazards for their users.

Laptop or notebook computers are often placed on one's lap with direct contact to the skin or separated by only a thin layer of clothing in between. Thus, the use of such a computer subjects the operator to electromagnetic radiation, of which the dangers are great. Many health professionals believe that exposure to high levels of electromagnetic radiation can lead to cancer. The radiation is also harmful to unborn children. Since laptop computers are often placed near the stomach and groin area, infertility becomes a risk as well. Health professionals often recommend limiting exposure to electromagnetic fields of over 2.5 mG of intensity. However, laptop computers often emit fields in excess of 150 mG, which is 60 times greater than the safe level. Therefore, there is a direct need to attenuate these fields to safe levels.

Existing prior art includes U.S. Pat. No. 5,336,848 to Katz (1994). The invention referenced in this patent is a box-like device that the laptop or notebook computer is placed upon. The box-like design of Katz is large, cumbersome, and not very portable. It also requires a grounding wire for the electromagnetic radiation attenuation to function.

The invention described herein solves these disadvantages by providing an apparatus for the attenuating of electromagnetic radiation for use with laptop computers which containing a forward electromagnetic radiation attenuating surface and which is more compact, lighter, and cheaper, than the device taught in Katz. Further, and perhaps more importantly, it does not require a grounding wire to function.

SUMMARY OF THE INVENTION

The electromagnetic radiation attenuating device for laptop computers disclosed herein comprises a layered support substrate, wherein said support substrate comprises at least one of the following electromagnetic radiation attenuating layers: an electrically conductive fabric; a microwave absorbing layer; or a magnetic shielding layer. The support substrate further comprises a surrounding material which envelops the entirety of the electromagnetic radiation attenuating layers. The support substrate is formed to include a forward electromagnetic radiation attenuating surface and is intended for use with laptop computers to attenuate electromagnetic radiation in the downward and forward directions.

In another form of the invention the electromagnetic radiation attenuating device for laptop computers comprises a forward electromagnetic radiation attenuating surface which further comprises an upper surface which is offset from said support substrate thereby allowing a laptop to be inserted between the upper surface and the support substrate and wherein both the upper surface and the forward electromagnetic radiation attenuating surface comprise the same electromagnetic radiation attenuating layers as the support substrate.

In yet another form of the invention the electromagnetic radiation attenuating device for laptop computers comprises an upper surface which further contains a cutout sized to receive a laptop's trackpad when a laptop is inserted between the upper surface and the support substrate.

BRIEF DESCRIPTION OF THE DRAWING FIGURES

Other advantages of the present invention will be readily understood by reference to the following detailed description in connection with the accompanying drawings wherein.

DESCRIPTION OF THE VARIOUS EMBODIMENTS

Figure 3:
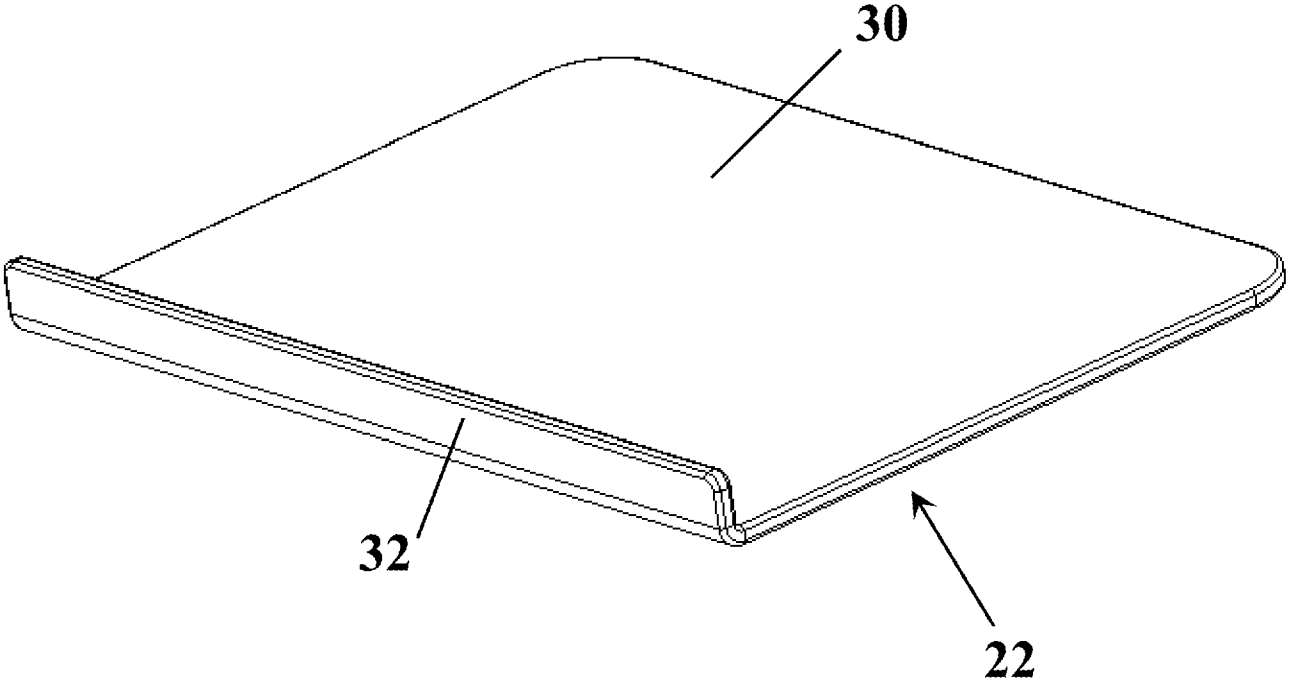
FIG. 3 is a perspective view of an electromagnetic radiation attenuating device for laptop computers comprising a forward electromagnetic radiation attenuating surface.
Figure 4:
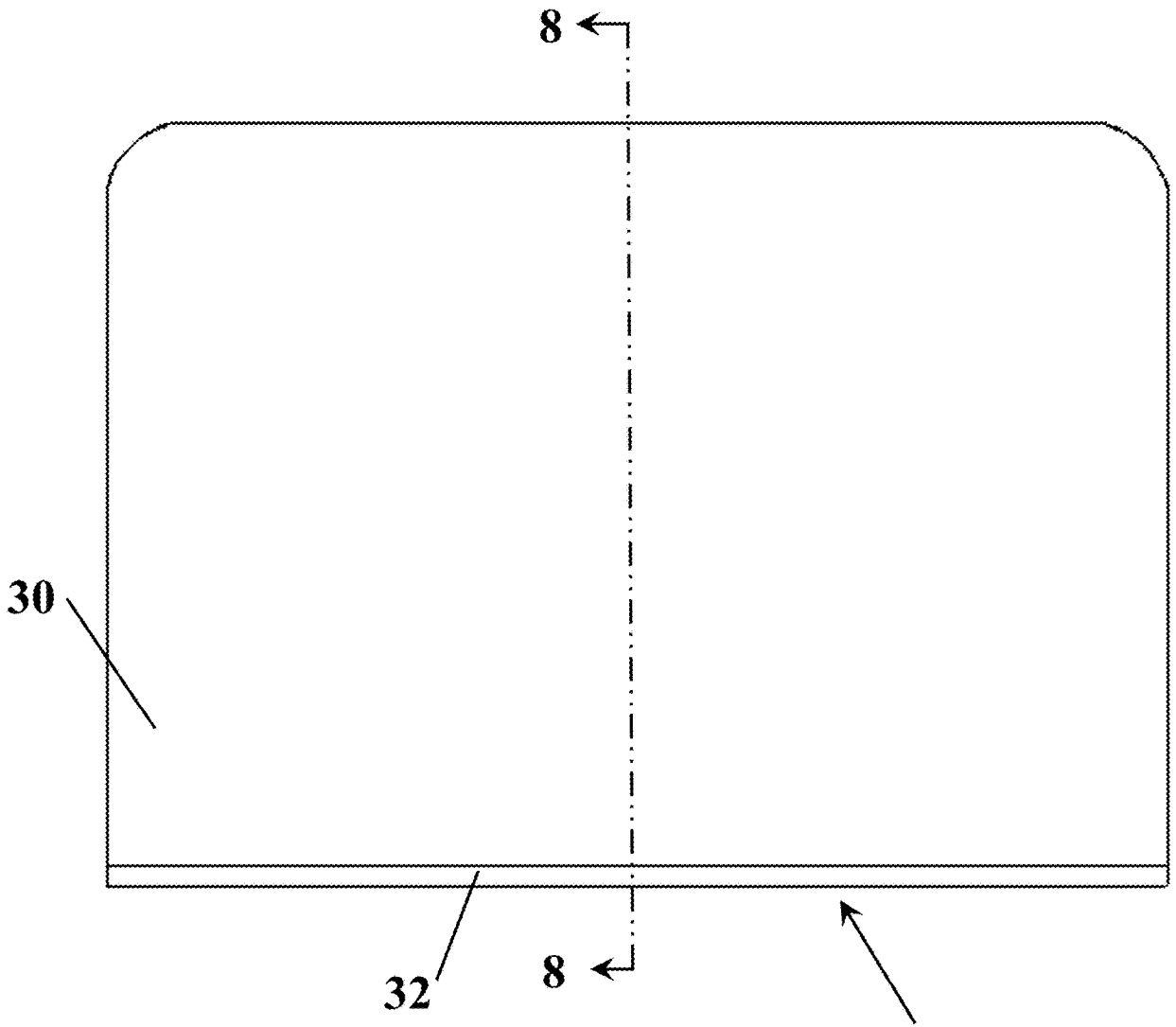
FIG. 4 is a top view of an electromagnetic radiation attenuating device for laptop computers comprising a forward electromagnetic radiation attenuating surface.
Figure 5:
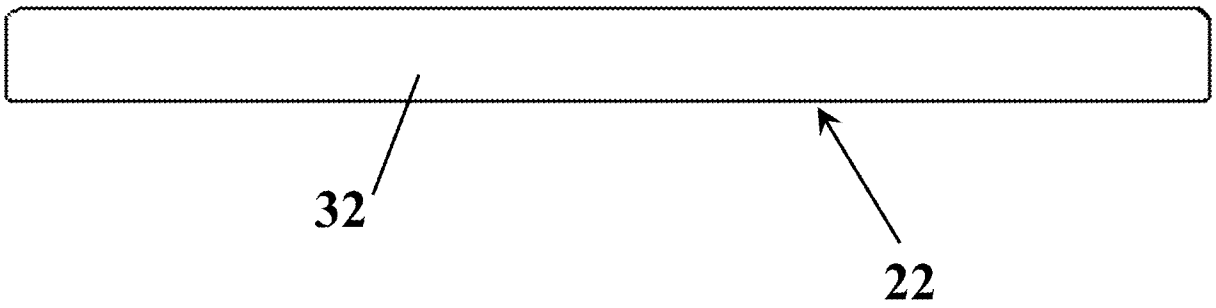
FIG. 5 is a front view of an electromagnetic radiation attenuating device for laptop computers comprising a forward electromagnetic radiation attenuating surface.
Figure 6:
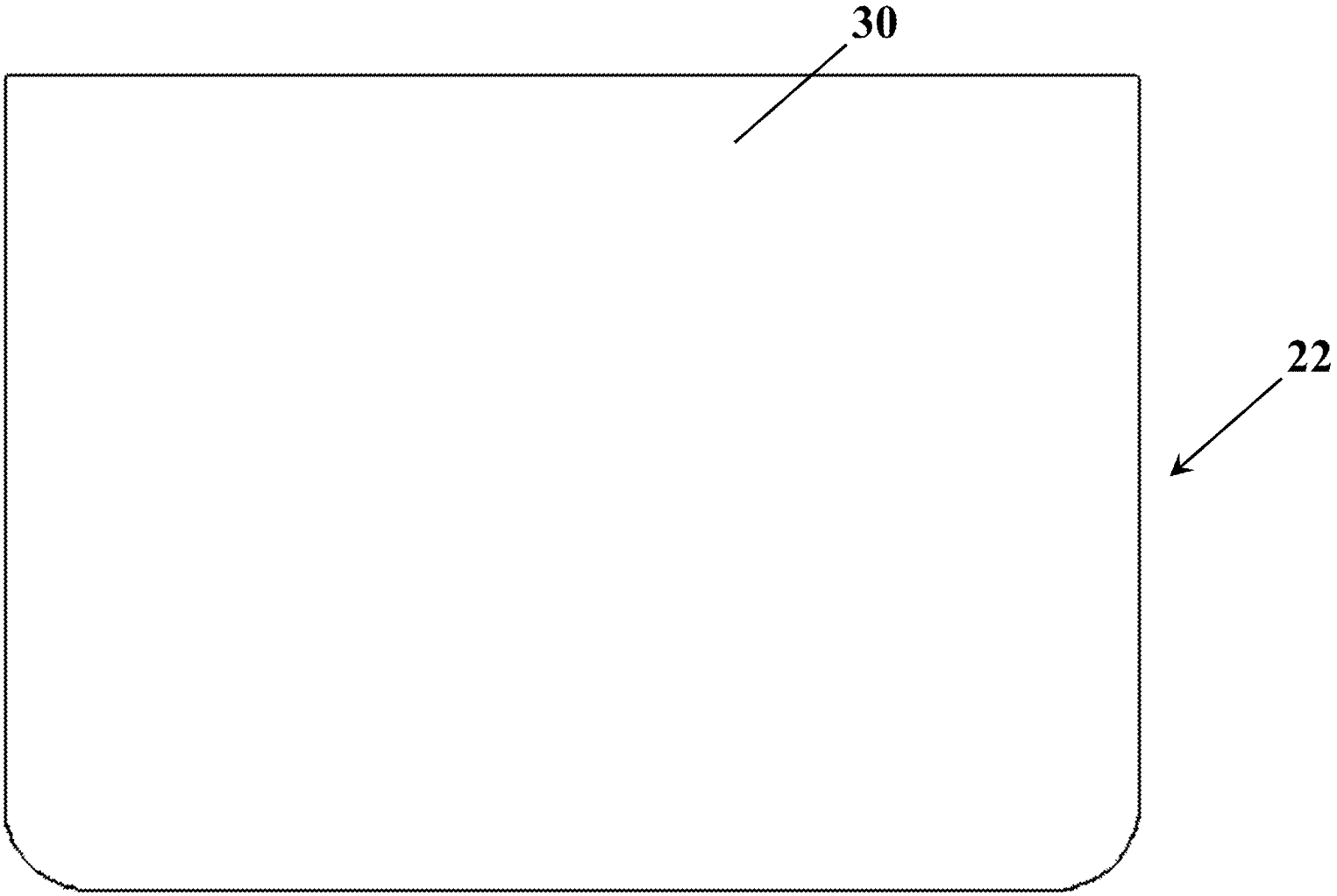
FIG. 6 is a bottom view of an electromagnetic radiation attenuating device for laptop computers comprising a forward electromagnetic radiation attenuating surface.
Figure 7:
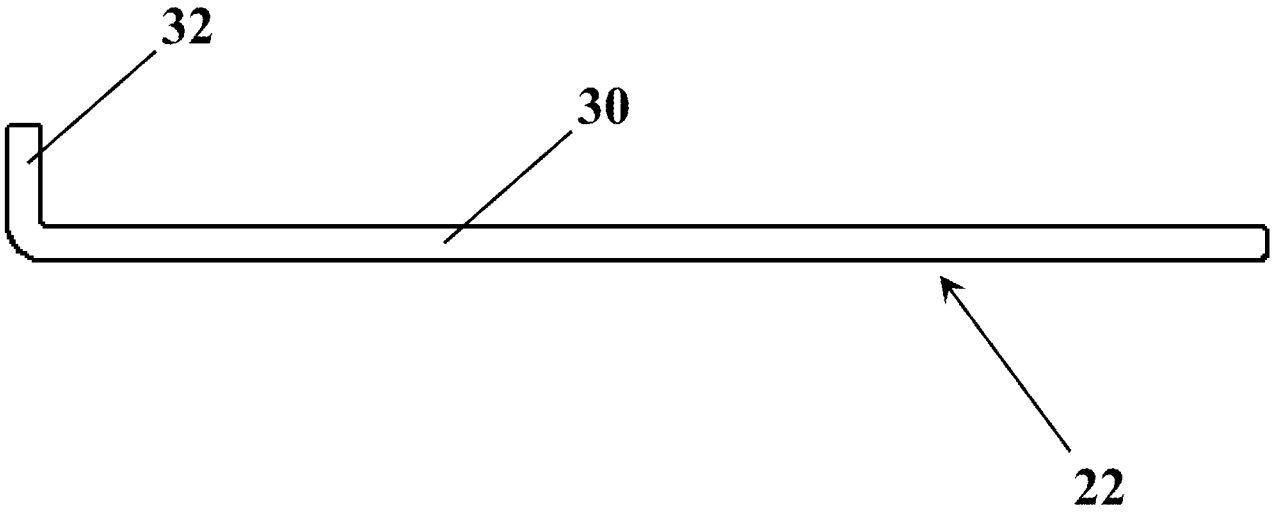
FIG. 7 is an elevation view of an electromagnetic radiation attenuating device for laptop computers comprising a forward electromagnetic radiation attenuating surface.

For purposes of the following description, the terms "left," "rear," "front," "vertical," "horizontal" and derivatives of such terms shall relate to the invention as oriented in FIG. 3. Terms such as "forward" mean toward the user of the device, and terms such as "upper" and "lower" mean above and below the base level of the substrate as shown in FIG. 3. However, it is to be understood that the invention may assume various alternative orientations and configuration, except where expressly specified to the contrary. It is also to be understood that the devices illustrated in the attached drawings, and described in the following specification are simply exemplary embodiments of the inventive concepts described herein. Specific dimensions and other physical characteristics relating to the embodiments disclosed herein are not to be considered as limiting unless expressly stated otherwise.

Figure 1:
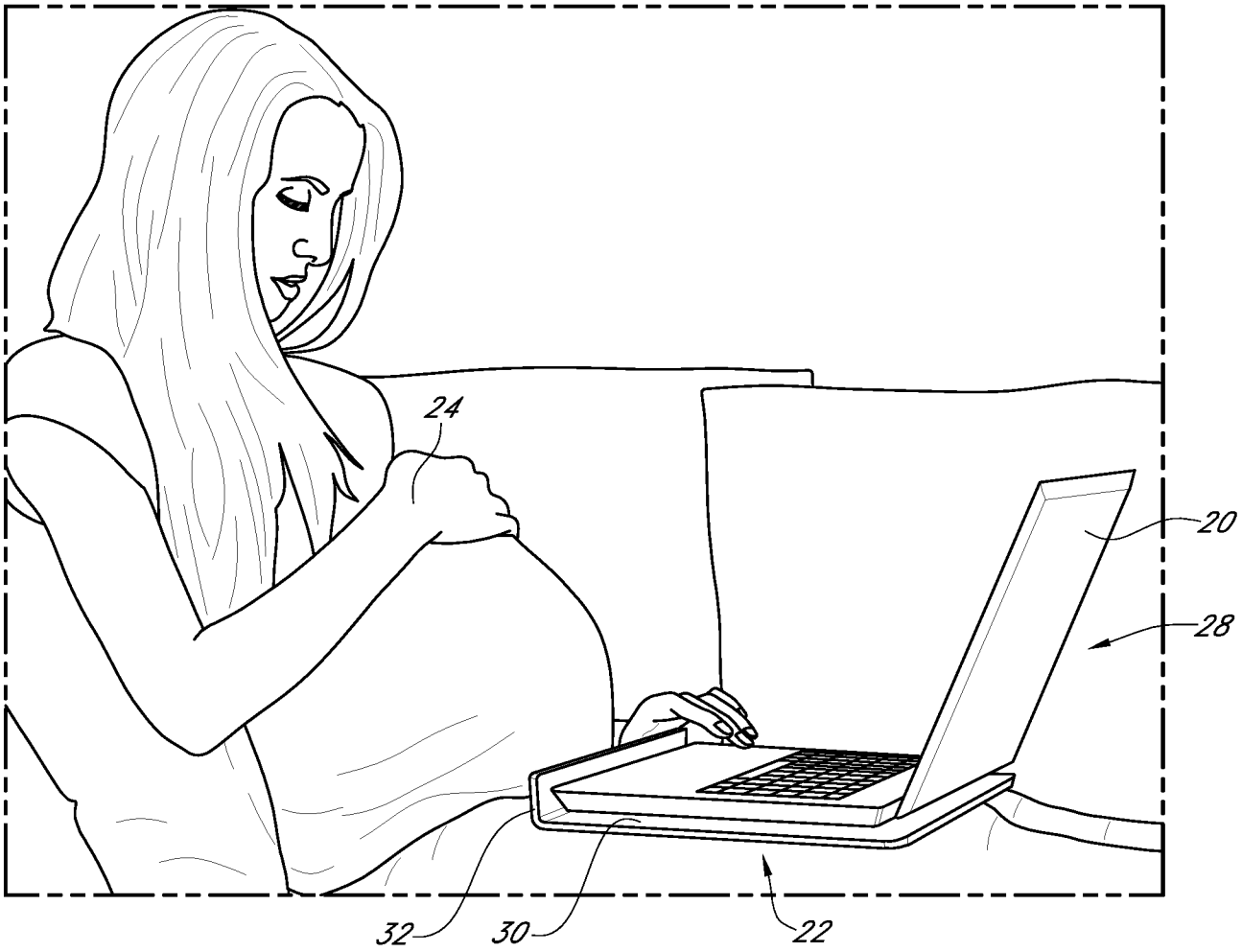
FIG. 1 is a perspective view of an electromagnetic radiation attenuating device for laptop computers shown in its intended environment, attenuating radiation away from a laptop user.
Figure 2:
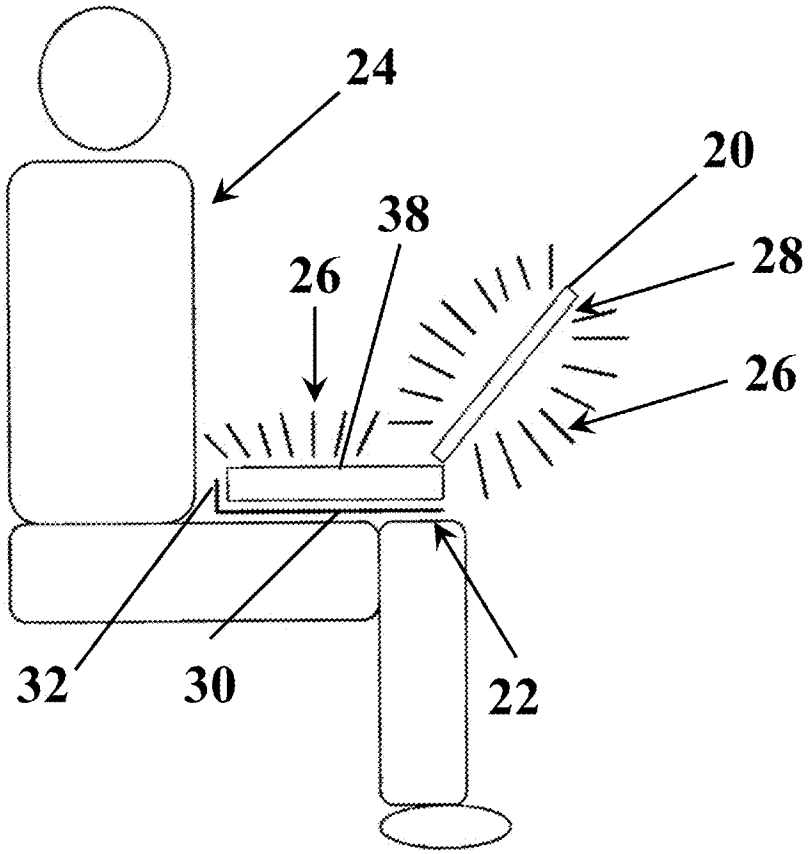
FIG. 2 is an elevation view of an electromagnetic radiation attenuating device for laptop computers shown in its intended environment, attenuating radiation away from a laptop user in the downward and forward directions simultaneously.

FIG. 1 shows one intended use for the electromagnetic radiation attenuating device for a laptop computer 20. The device, hereinafter referred to as a laptop shield 22, protects a user 24 by attenuating electromagnetic radiation 26 generated from an electronic device 28. As shown in FIG. 2, this radiation 26 is distributed in all directions from the device, and would normally be absorbed by the user 24, if not for the laptop shield 22.

FIGS. 3, 4, 5, 6 and 7 show various orientations of this first embodiment of the laptop shield 22. The base element of the device is a support substrate 30 on which an electronic device 28 is intended to be placed. This support substrate 30 is intended to be placed between the electronic device 28 and the user 24. As shown best in FIG. 8, the laptop shield 22 also includes a forward surface 32 or lip, which is ideally perpendicular to the substrate, however may be placed at any angle to the substrate 30.

In order to attenuate electromagnetic radiation 26 generated by the electronic device 28, a series of electromagnetic radiation attenuating layers 34 (generally) are placed inside of the support substrate 30 and the forward surface 32. This forms an electromagnetic radiation attenuating support substrate 30 and a forward electromagnetic radiation attenuating surface 32.

Since electromagnetic radiation (EMR) is a three-dimensional field, the radiation 26 is emitted from the electronic device 28 travels in all directions resulting in a sphere-shaped field. This causes a dilemma when a flat product is placed underneath the electronic device 28 because the flat product can only provide radiation attenuation in the downward direction, but cannot do so in the forward direction, e.g. toward the user 24. In effect, flat products only providing EMR attenuation below the laptop.

Figure 10:
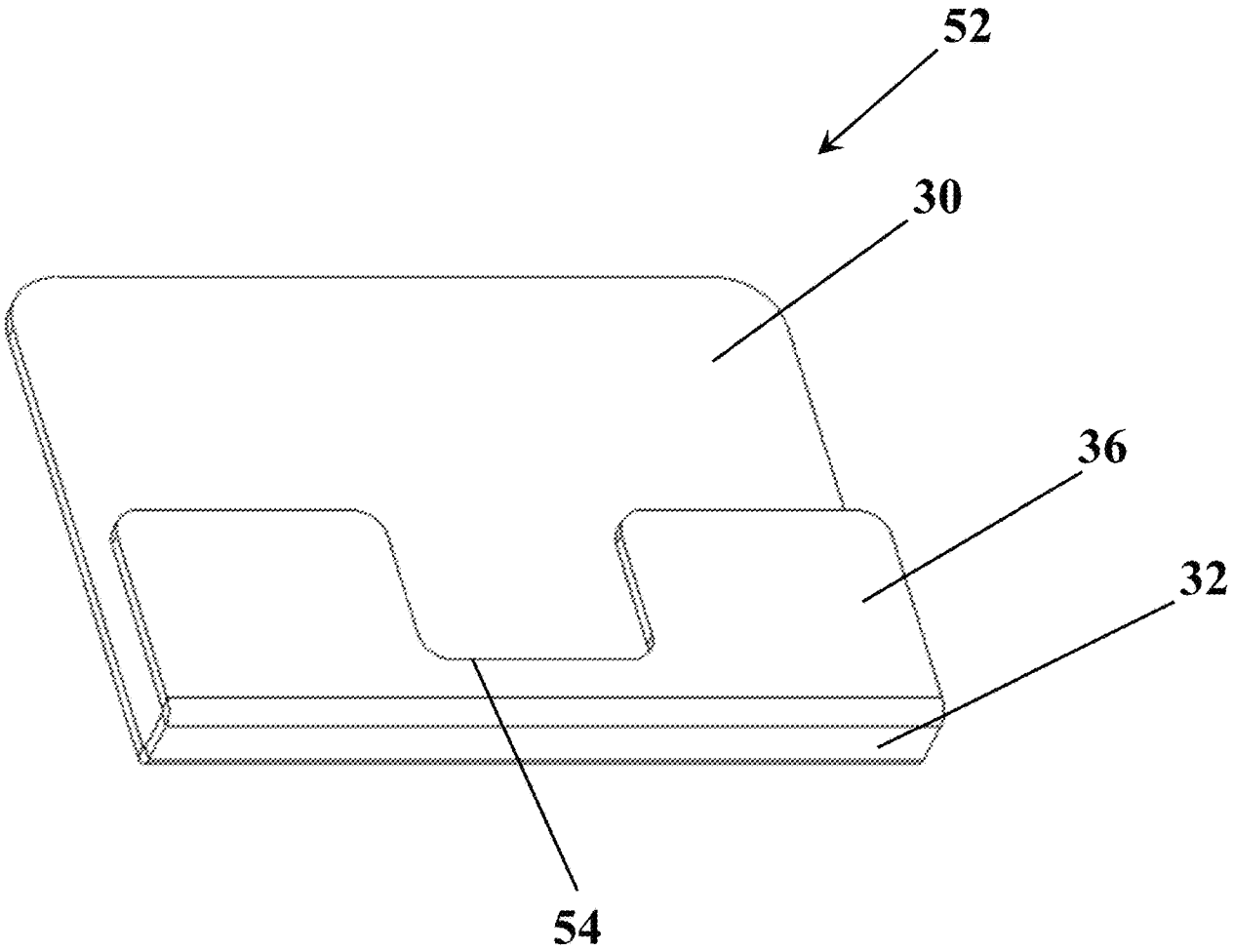
FIG. 10 is a perspective view of an alternate embodiment of the electromagnetic radiation attenuating device for laptop computers comprising a forward electromagnetic radiation attenuating surface and an upper surface which is offset from said support substrate and which contains a cutout for a trackpad.

The laptop shield 22 shown herein addresses a critical need, to block radiation 26 in the direction of the user 24. FIGS. 1 through 9 show a first embodiment with a 90° bend in the front creating a forward electromagnetic radiation attenuating surface 32 which provides radiation attenuation underneath and in front of the electronic device 28. An alternate embodiment having an upper surface 36 (See FIGS. 10 and 11) further improves radiation shielding by providing EMR attenuation underneath, in front, and above the laptop 20 simultaneously.

The increased EMR 26 attenuation provided by these embodiments are extremely advantageous because they keep the user 24 safer. Specifically, they are quite useful for pregnant women wanting to minimize EMR exposure to the fetus when using a laptop computer on their lap or closer to their body (See FIG. 1), and still be able to access the laptop's keyboard 38 during use.

Figure 8:
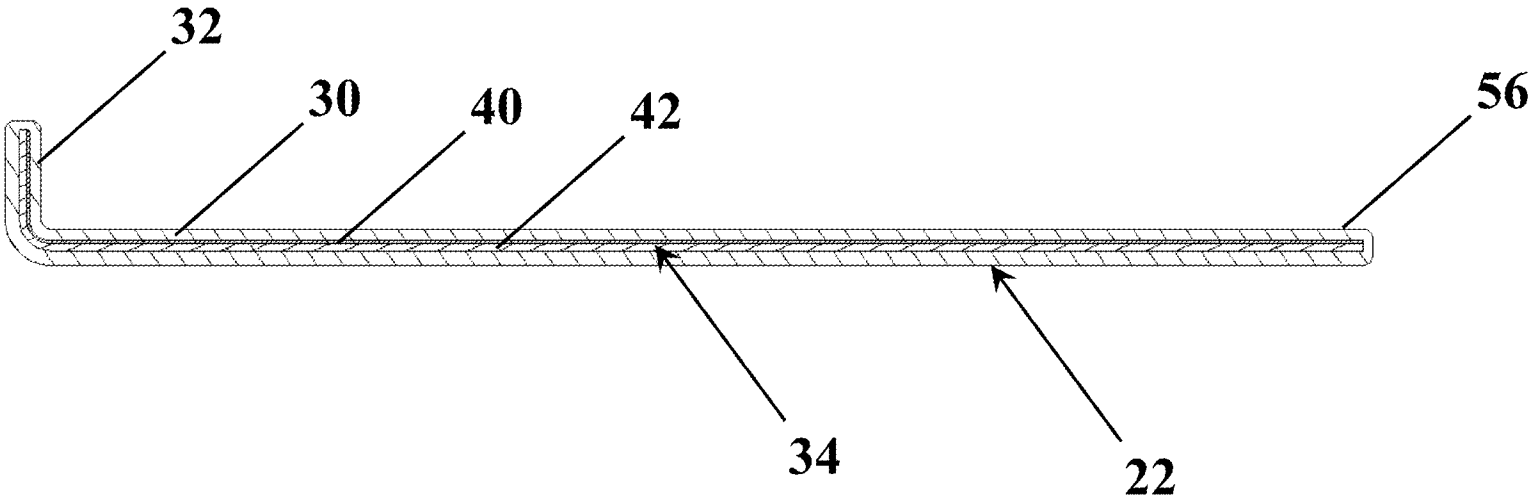
FIG. 8 is a cross sectional view of the section shown in FIG. 4 showing a first embodiment of the invention comprising two electromagnetic radiation attenuating layers.
Figure 9:
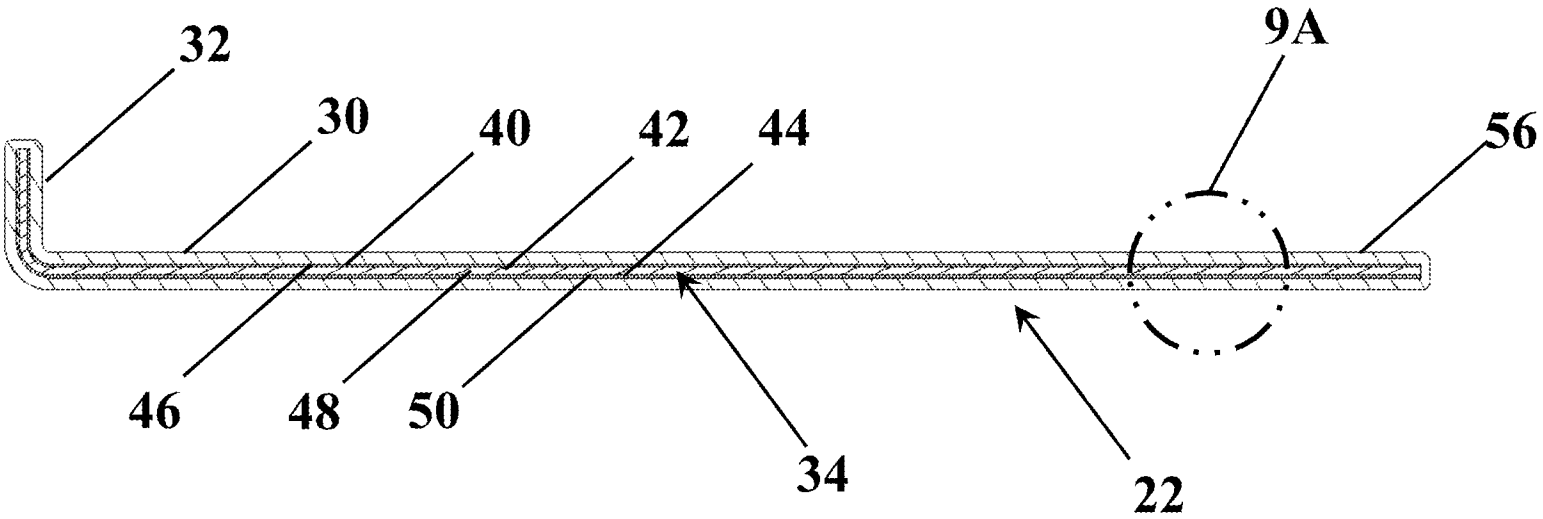
FIG. 9 is a cross sectional view of the section shown in FIG. 4 showing a second embodiment of the invention comprising three electromagnetic radiation attenuating layers.
Figure 9A:
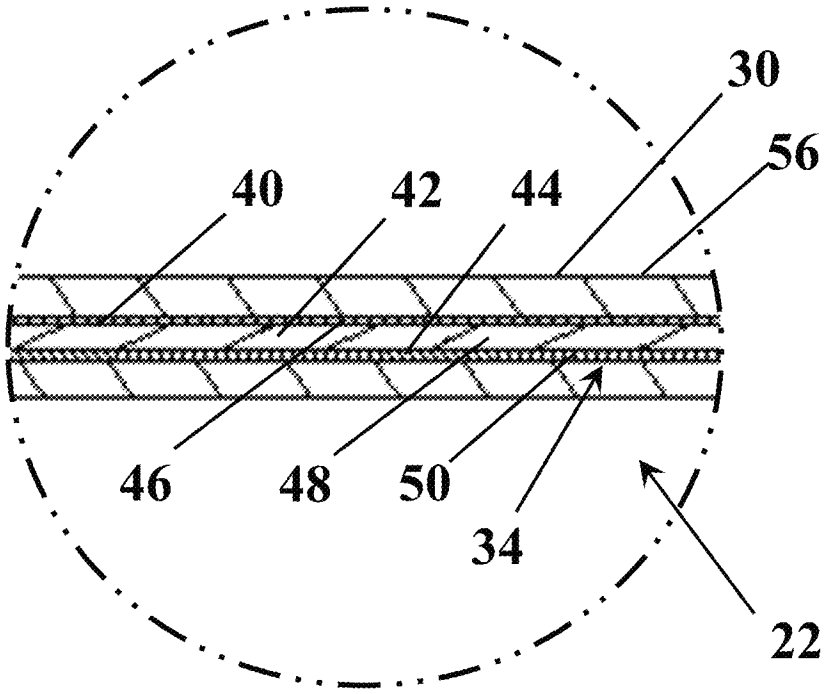
FIG. 9A is a detail view of the section shown in FIG. 9 detailing the three-electromagnetic radiation attenuating layers.

In a first form of the invention shown in FIG. 8, the laptop shield 22 has two radiation attenuating layers, a first layer 40, and a second layer 42. In a second form of the invention shown in FIG. 10, the laptop shield 22 has three radiation attenuating layers, a first layer 40, a second layer 42, and a third layer 44. These layers 34 absorb and attenuate radiation 26 from the device 28 and reduce its transmission to the user 24.

Due to the multiple different types and frequencies of electromagnetic radiation 26 emitted by various electronic devices 28, multiple different types of shielding materials may be included for proper attenuation. Not all of the materials, however, are required for every product. For example, a customer that does not use WIFI in their home may elect not to include the shielding material that attenuates the WIFI field. Therefore, there are several variants of the invention each of which carry one or more of the following materials: magnetic shielding foil 46, microwave absorbing material 48, or a conductive fabric 50.

Magnetic Shielding Foil (46)

A magnetic shielding foil 46 is a metal alloy comprised mostly of Nickel and Iron. This material addresses the Extremely Low Frequency (ELF) magnetic field that is present any time there is electric current flowing through a conductor. This material is very conductive and has a high magnetic permeability. It acts as a path of least resistance for the ELF magnetic field to flow through because less energy is required for the field to travel through this material than through the air. This layer of material prevents the magnetic field from traveling through the air into the user 24, thus providing EMR shielding. One form of this material is called Magnetic Shielding Foil and is commercially available through Less EMF Inc, of Latham, N.Y. 12110.

Microwave Absorbing Material (48)

Figure 16:
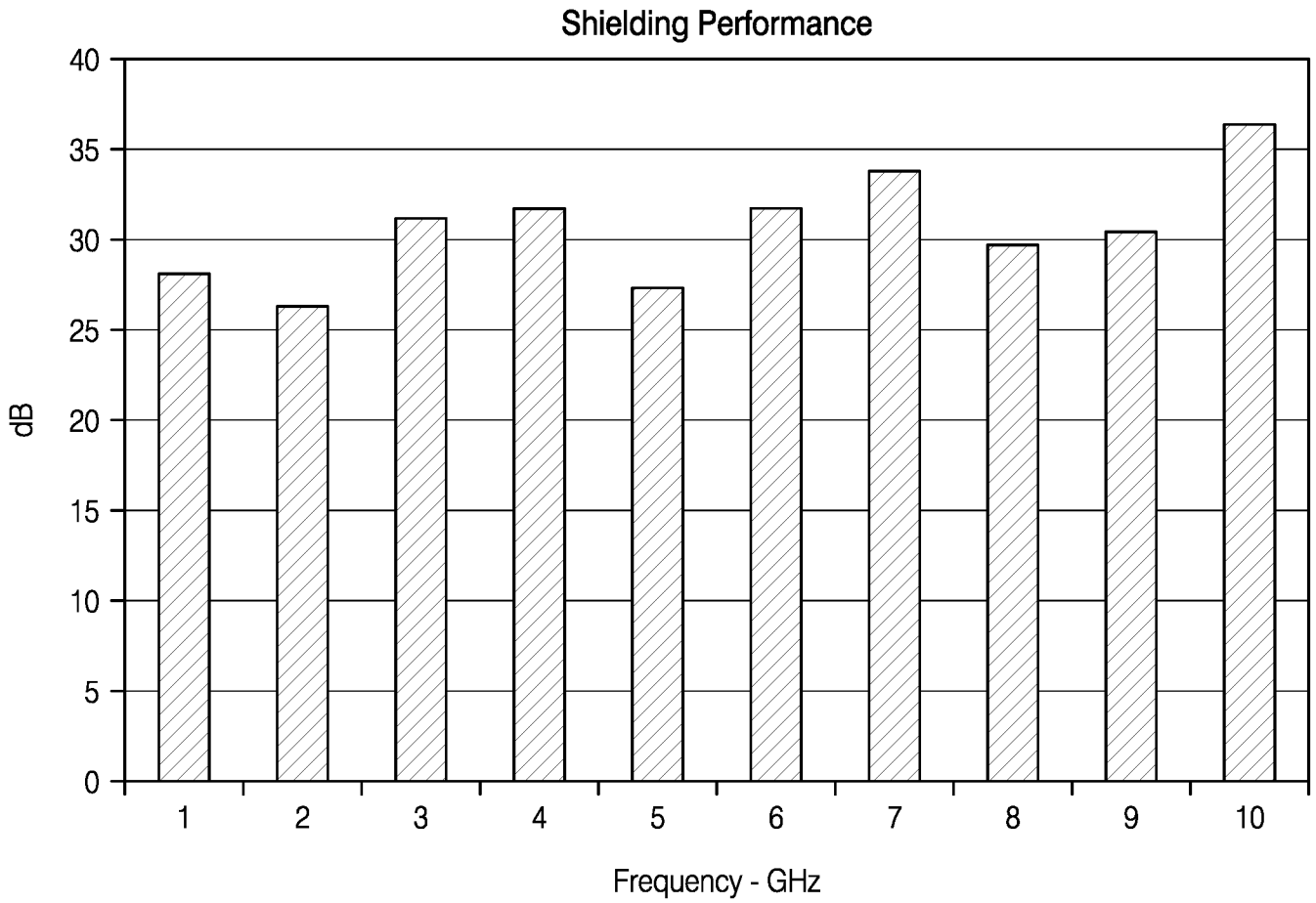
FIG. 16 shows the EMR reduction in dB for a microwave absorbing material

A microwave absorbing material 48 is comprised of non-woven, nearly-pure Carbon fibers preferably formed into a sheet. This material addresses the highest frequency EMR by absorbing the field. One form of this material is called microwave absorbing material and is commercially available through Less EMF Inc, of Latham, N.Y. 12110. The graph in FIG. 16 shows the attenuation/reduction obtained for fields of varying frequencies.

Electrically Conductive Fabric (50)

Figure 17:
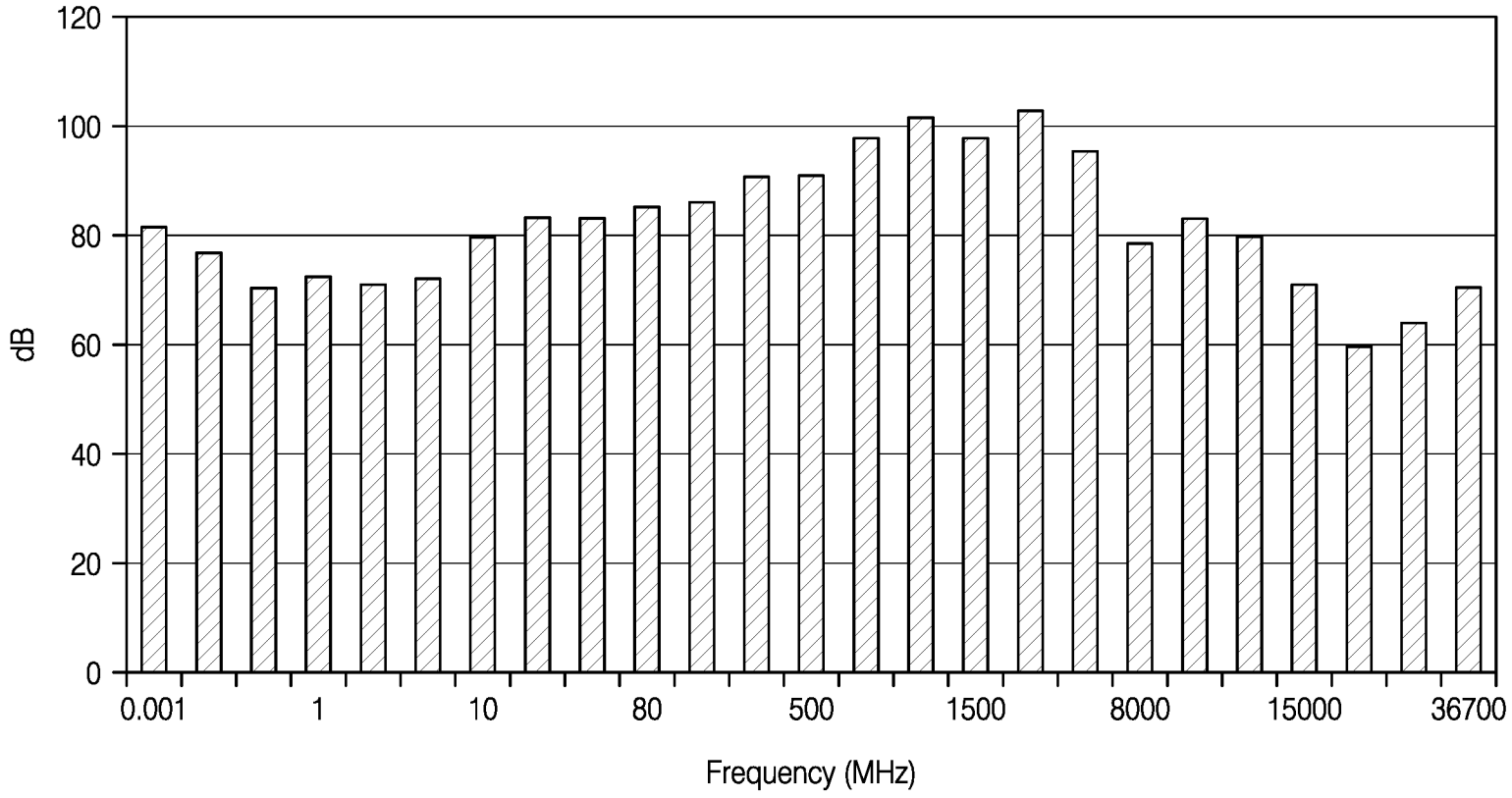
FIG. 17 shows the EMR reduction in dB across the spectrum for a conductive fabric

The material to address the mid-range frequency levels of EMR is a conductive fabric 50. Some good options for this material include a polyester fabric that is coated with a variety of conductive materials including pure copper, nickel, silver, or any combination of these. This layer when combined with the other two, takes care of the remaining frequencies of EMR by reflecting the field away from the body. One form of this material is called Pure Copper Polyester Taffeta Fabric and is commercially available through Less EMF Inc, of Latham, N.Y. 12110. FIG. 17 shows a graph of the effectiveness of such a conductive fabric 50.

As mentioned earlier, all three layers of materials are not always required. Anticipated embodiments include the following combinations of materials:

1) Magnetic shielding foil alone;
2) Microwave absorbing material alone;
3) Electrically conductive fabric alone;
4) Magnetic shielding foil in combination with microwave absorbing material;
5) Magnetic shielding foil in combination with electrically conductive fabric;
6) Microwave absorbing material in combination with electrically conductive fabric; and
7) Magnetic shielding foil in combination with a microwave absorbing material and an electrically conductive fabric.

Further embodiments are also envisioned, in which the orders of the layers presented above are varied. Additional embodiments may also include multiple layers of the materials described above. However, nonfunctional layers, such as filler layers made of materials such as plastic, wood, or tin, which are shown to provide no significant shielding to magnetic, electrical, or microwave energy and are not considered to be part of an electromagnetic radiation attenuating layers 34 described in this invention.

Figure 11:
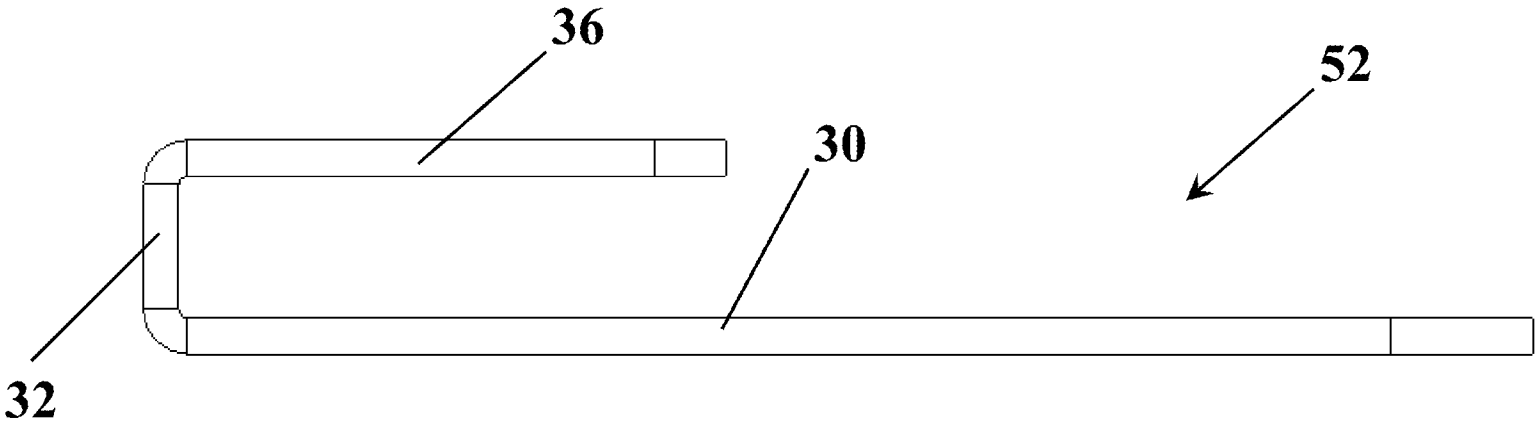
FIG. 11 is an elevation view of an alternate embodiment of the electromagnetic radiation attenuating device for laptop computers comprising a forward electromagnetic radiation attenuating surface and an upper surface which is offset from said support substrate.
Figure 12:
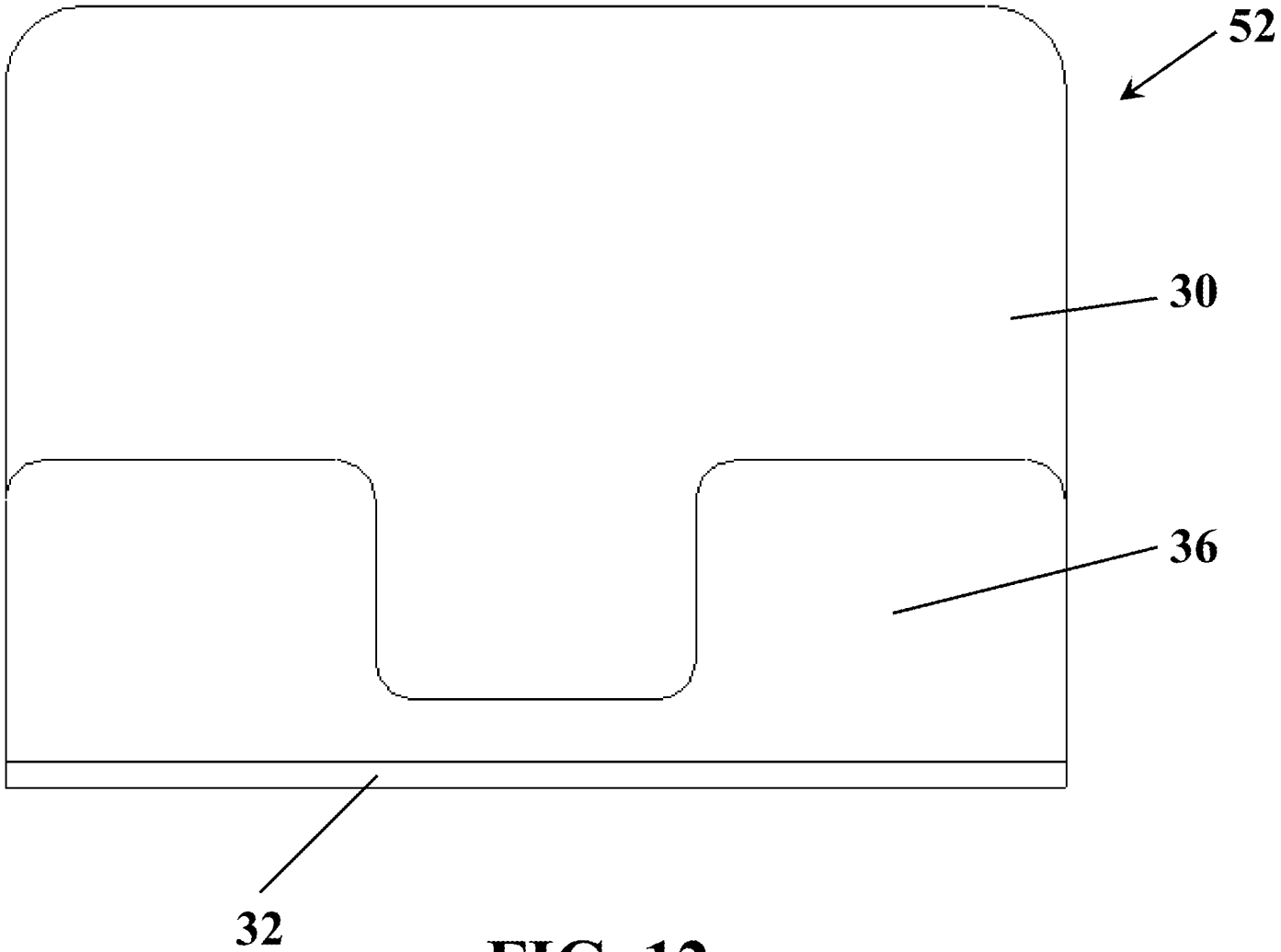
FIG. 12 is an top view of an alternate embodiment of the electromagnetic radiation attenuating device for laptop computers comprising a forward electromagnetic radiation attenuating surface and an upper surface containing a cutout for a trackpad.
Figure 13:
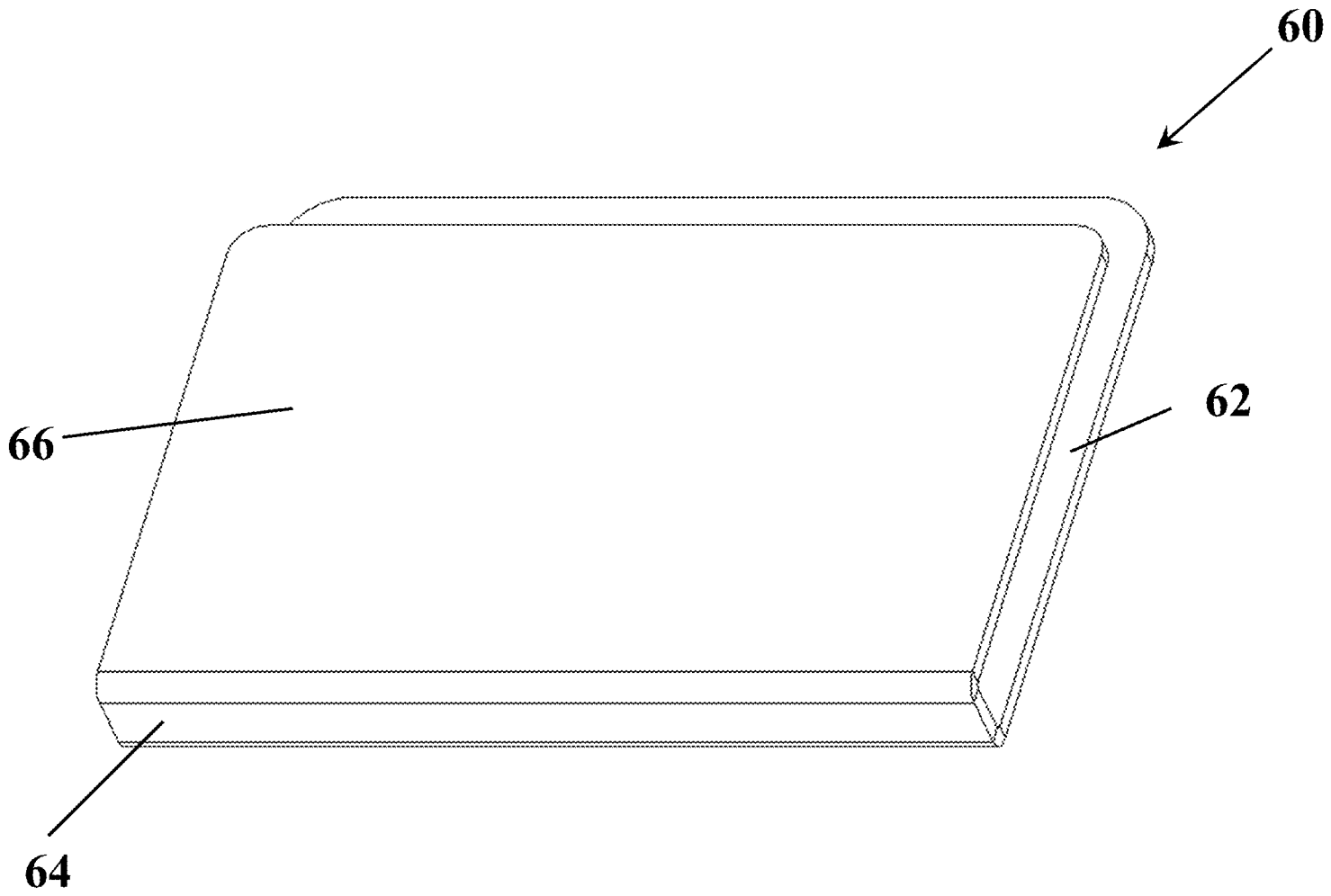
FIG. 13 is a perspective view of yet another an alternate embodiment of the electromagnetic radiation attenuating device for laptop computers comprising an extended upper surface which covers the computer keyboard which blocks electromagnetic radiation in the upward direction.
Figure 14:
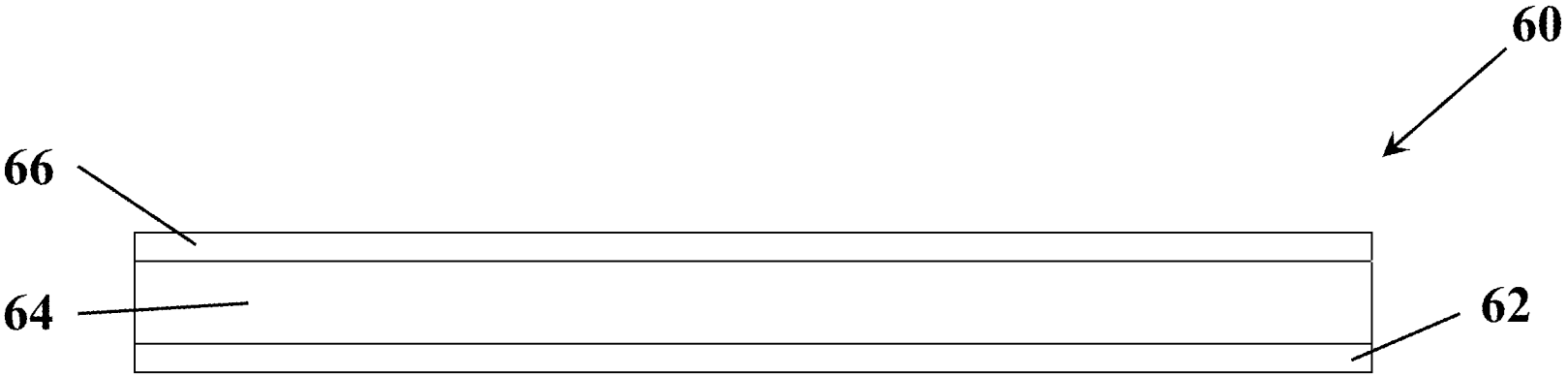
FIG. 14 is a rear view of the alternate embodiment of the electromagnetic radiation attenuating device for laptop computer with an extended upper surface.
Figure 15:
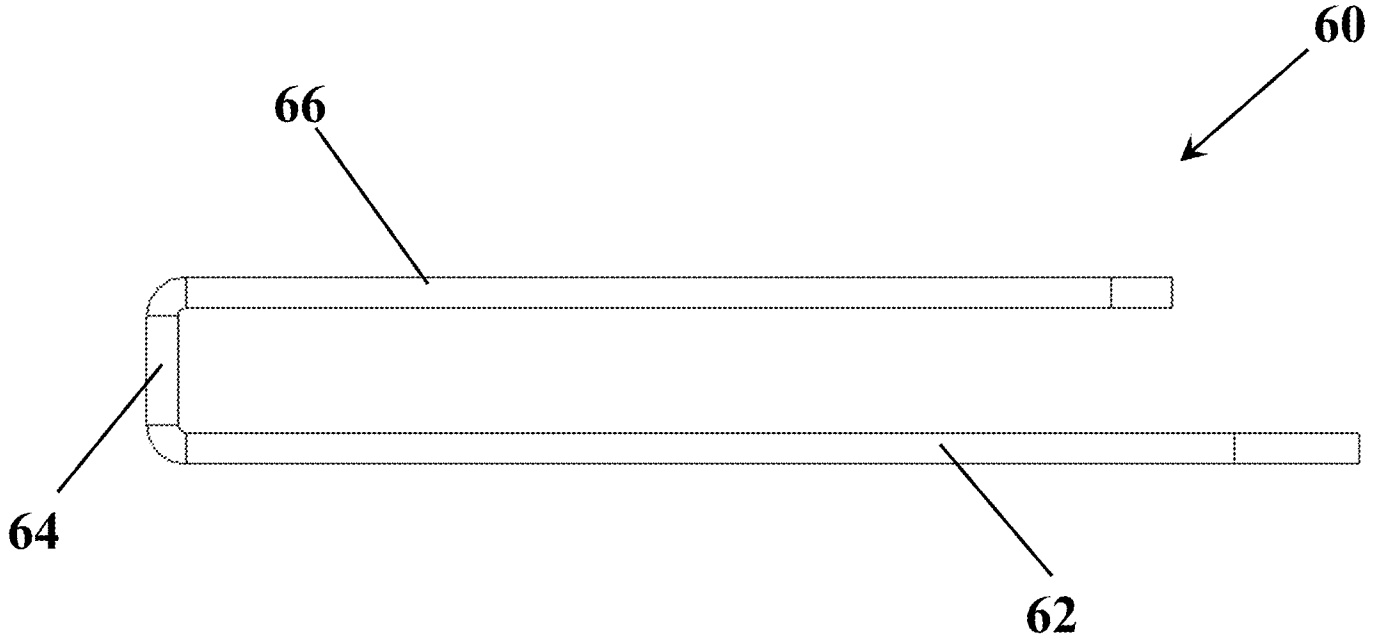
FIG. 15 is an elevation view of the alternate embodiment of the electromagnetic radiation attenuating device for laptop computer with an extended upper surface.

Another alternate embodiment 52 of the invention provides additional shielding for radiation in the upward direction. The embodiment is show in FIG. 10 and includes a cutout 54 for a laptop computer's trackpad. This embodiment contains radiation shielding in its upper surface and preferably uses the same radiation absorbing layers as used in the rest of the device. As shown in FIG. 11, the upper surface 36 is preferably offset from and parallel to the support substrate 30, and is offset a sufficient distance to allow for the fitment of a laptop computer 20 between the upper surface 36 and the support substrate 30. In this embodiment, the shielding material is preferably trimmed prior to molding or laminating to prevent the shielding material from being visible in the cutout 54 area and to allow for complete envelopment by an outer layer 56.

In yet another embodiment of the invention 60, the upper surface may be extended creating an extended upper surface 66 which is attached to a forward surface 64 and is offset from, and preferably parallel with, a support substrate 62. This embodiment also contains radiation shielding in its upper surface and preferably uses the same radiation absorbing layers as used in the support substrate 62. In this embodiment, the upper surface is offset from the support substrate 62 sufficiently to insert a laptop computer 20, between the extended upper surface 66 and the substrate 62. It is preferred in this embodiment that the extended upper surface 66 cover the entirety of the laptop's keyboard 38 in order to maximize radiation shielding in the upward direction. Therefore, the upper surface 66 is nearly as long as the support substrate 62, but is not the same length. It is desired that this difference in length is equivalent to the approximate width of the laptop's screen plus its hinge mechanism. This is done so that the laptop shield with extended upper surface 60 forms a tight fit to the laptop 20, without pressing against the screen. Since this embodiment covers the keyboard 38, an external keyboard must be used with this design. This keyboard may be attached to the laptop in various ways known in the art, including through the use of USB ports located on the sides of the laptop. These ports would not be obscured by the laptop shield 60 in this embodiment.

Results in Operation

The laptop shield 22 described herein blocks radiation 26 in the direction of the user 24. FIGS. 1 through 9 showing the first embodiment with a 90° bend in the front creating a forward electromagnetic radiation attenuating surface 32 which provides radiation attenuation underneath and in front of the electronic device 28. An alternate embodiment having an upper surface 36 (See FIGS. 10 and 11) further improves radiation shielding by providing EMR attenuation underneath, in front, and above the laptop 20 simultaneously. Further, in one embodiment of the invention, when a RF generating device, such as a laptop is placed onto the support substrate 62 having at least one layer of the Conductive Fabric and at least one layer of the Microwave Absorbing Materials specified above, there can be an attenuation of at least 20 db reduction of RF signals in the 1-10 Ghz range and at least a 40 dB reduction of RF signals in the 1 Hz to 36700 Hz range when measured through the electromagnetic radiation attenuating layers.

Manufacturing Method

The aforementioned embodiments may be manufactured in many ways, and the manufacturing method selected largely depends on the outer material selected to enclose the electromagnetic radiation attenuating layers 34. Two possible outer layers 56 are plastic and wood.

For designs with a plastic outer layer 56, these products may be injection molded. In one form of molding the outer shell is molded in its final shape, however it is molded in two parts: upper and lower halves. These halves are then assembled with the electromagnetic radiation attenuating layers 34 sandwiched inside.

In yet another manufacturing method, the plastic embodiment may be manufactured using flat sheets of stock plastic. The outer layers 56 may be glued, sonic welded, or otherwise adhered around the electromagnetic radiation attenuating layers 34. Then after assembly, the flat form can be bent as necessary by heating of the product and shaping it to its final shape. Alternately, the shielding materials may be placed directly into an injection mold and then the plastic outer layers 56 are over-molded around the electromagnetic radiation attenuating layers 34.

For wood products, layers of veneer, substrate material such as MDF, or solid wood, are placed into a mold along with the electromagnetic radiation attenuating layers 34. The wood products are then laminated using an adhesive which is placed between layers. Pressure, heat, or both are then applied until the adhesive sets. The final shaping of the device may also occur during this process bending the wood as needed. These laminated sheets may then be trimmed or sanded if necessary to achieve the final desired shape.

The above description is considered that of the preferred embodiments only. Modifications to the invention will occur to those skilled in the art and those who make use of the invention. Therefore, it is understood that the embodiments shown in the drawings and the examples set forth herein are described merely for illustrative purposes, and are not intended to limit the scope of the invention as interpreted according to the principles of patent law, including the doctrine of equivalents.

The invention claimed is:

1. An apparatus for attenuating electromagnetic radiation, the apparatus comprising:

a support substrate with an electromagnetic radiation attenuating layer;

wherein said support substrate further comprises a surrounding material enveloping said electromagnetic radiation attenuating layer;

wherein said support substrate further includes a forward electromagnetic radiation attenuating surface;

wherein said forward electromagnetic radiation attenuating surface further comprises an upper electromagnetic radiation attenuating surface which is offset from said support substrate thereby allowing an electronic device to be inserted between said upper electromagnetic radiation attenuating surface and the support substrate; and wherein said upper electromagnetic radiation attenuating surface is substantially parallel to said support substrate.

2. The apparatus as defined in claim 1, wherein said forward electromagnetic radiation attenuating surface is perpendicular to said support substrate and comprises the same electromagnetic radiation attenuating layer as said support substrate.

3. The apparatus as defined in claim 1, wherein upper electromagnetic radiation attenuating surface is of equal thickness to said support substrate.

4. The apparatus as defined in claim 1, wherein said electromagnetic radiation attenuating layer further comprises a first layer and a second layer; and wherein the first layer and the second layer are constructed of different materials.

5. The apparatus as defined in claim 1, wherein said electromagnetic radiation attenuating layer further comprises: a magnetic shielding layer; and a conductive fabric layer.

6. The apparatus as defined in claim 1, wherein said electromagnetic radiation attenuating layer further comprises: a magnetic shielding layer; a conductive fabric layer; and a microwave absorbing layer.

7. The apparatus as defined in claim 1, wherein said electronic device is a laptop computer.

8. The apparatus as defined in claim 7, wherein said upper electromagnetic radiation attenuating surface contains a cutout sized to allow for the use of a laptop's trackpad when said laptop computer is inserted between the upper electromagnetic radiation attenuating surface and the support substrate.

9. The apparatus as defined in claim 7, wherein the length of said upper electromagnetic radiation attenuating surface is sized to cover a laptop's keyboard, when the laptop computer is placed within the apparatus.

10. The apparatus as defined in claim 7, wherein the length of said upper electromagnetic radiation attenuating surface is sized to cover the entirety of a laptop's keyboard when said laptop computer is placed within the apparatus.

11. The apparatus as defined in claim 1, wherein the length of said upper electromagnetic radiation attenuating surface is at least 30% of the length of the substrate.

12. The apparatus as defined in claim 1, wherein the length of said upper electromagnetic radiation attenuating surface is at least 50% of the length of the substrate.

13. The apparatus as defined claim 1, wherein the length of said upper electromagnetic radiation attenuating surface is at least 75% of the length of the support substrate.

14. The apparatus as defined in claim 1, wherein said electromagnetic radiation attenuating layer further comprises a first layer and a second layer.

15. The apparatus as defined in claim 1, wherein said electromagnetic radiation attenuating layer further comprises: a magnetic shielding layer; and a microwave absorbing layer.

16. The apparatus as defined in claim 1, wherein said electromagnetic radiation attenuating layer further comprises: a conductive fabric layer; and a microwave absorbing layer.

17. An apparatus for attenuating electromagnetic radiation comprising:

a support substrate having an electromagnetic radiation attenuating layer;

wherein said electromagnetic radiation attenuating layer further comprises: at least one magnetic shielding layer; at least one a conductive fabric layer; and at least one a microwave absorbing layer;

wherein said support substrate further comprises a forward electromagnetic radiation attenuating surface;

wherein said forward electromagnetic radiation attenuating surface has the same electromagnetic radiation attenuating layer as said support substrate;

wherein a surrounding material envelops said electromagnetic radiation attenuating layer contained in said support substrate and said forward electromagnetic radiation attenuating surface;

wherein said forward electromagnetic radiation attenuating surface is perpendicular to said support substrate; and wherein said forward electromagnetic radiation attenuating surface further comprises an upper electromagnetic radiation attenuating surface which is offset from and parallel to said support substrate thereby allowing an electronic device to be inserted between said upper electromagnetic radiation attenuating surface and the support substrate.

18. An apparatus for attenuating electromagnetic radiation comprising:

a support substrate, having an electromagnetic radiation attenuating layer; wherein said electromagnetic radiation attenuating layer further comprises: at least one magnetic shielding layer; at least one a conductive fabric layer; and at least one a microwave absorbing layer;

wherein said support substrate further comprises a forward electromagnetic radiation attenuating surface and an upper electromagnetic radiation attenuating surface;

wherein said upper electromagnetic radiation attenuating surface is offset from and parallel to said support substrate thereby allowing a laptop computer to be inserted between said upper electromagnetic radiation attenuating surface and said support substrate;

wherein both of said upper electromagnetic radiation attenuating surface and said forward electromagnetic radiation attenuating surface have the same electromagnetic radiation attenuating layer as said support substrate;

wherein a surrounding material envelops said electromagnetic radiation attenuating layer;

wherein said forward electromagnetic radiation attenuating surface is perpendicular to said support substrate; and wherein said upper electromagnetic radiation attenuating surface further comprises a cutout sized to allow for the use of a laptop's trackpad when a laptop computer is inserted between the upper electromagnetic radiation attenuating surface and said support substrate.

* * * * *